US008122861B2

(12) United States Patent
Yuasa

(10) Patent No.: US 8,122,861 B2
(45) Date of Patent: Feb. 28, 2012

(54) TWO-STROKE CYCLE COMBUSTION ENGINE OF AIR SCAVENGING TYPE

(75) Inventor: Tsuneyoshi Yuasa, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 0 days.

(21) Appl. No.: 12/687,777

(22) Filed: Jan. 14, 2010

(65) Prior Publication Data

US 2010/0192928 A1 Aug. 5, 2010

(30) Foreign Application Priority Data

Jan. 30, 2009 (JP) ..... 2009-019181

(51) Int. Cl.
*F01L 3/20* (2006.01)

(52) U.S. Cl. ..... 123/65 V

(58) Field of Classification Search ..... 261/23.3, 261/45–47, 35, 44.6, 44.8; 123/73 BA, 73 CA, 123/586, 65 R, 179.18, 342, 337, 73 A, 73 P, 123/339.23; *F01L 3/20*
See application file for complete search history.

(56) References Cited

U.S. PATENT DOCUMENTS

| | | | | |
|---|---|---|---|---|
| 6,000,683 | A * | 12/1999 | Van Allen | 261/52 |
| 6,431,527 | B1 * | 8/2002 | Suzuki et al. | 261/44.3 |
| 6,827,338 | B2 * | 12/2004 | Nonaka | 261/44.3 |
| 7,104,526 | B2 * | 9/2006 | Mavinahally | 261/46 |
| 2006/0107912 | A1 * | 5/2006 | Hoche et al. | 123/73 A |
| 2009/0007894 | A1 | 1/2009 | Wada et al. | |

FOREIGN PATENT DOCUMENTS

| | | |
|---|---|---|
| JP | 2007-239463 | 9/2007 |

* cited by examiner

*Primary Examiner* — Michael Cuff
*Assistant Examiner* — Keith Coleman

(57) ABSTRACT

To provide a two-stroke cycle combustion engine of an air scavenging type, in which not only can transit from the idling condition to the rapid accelerating condition take place smoothly, but the combustion engine can be smoothly started, there are provided scavenging passages (30, 31) for introducing an air/fuel mixture (M) and an air (A) into a combustion chamber (1*a*), a valve unit (51, 50) for adjusting the opening of each of an air passage (23) for supplying the air (A) to the scavenging passage (30) and an air/fuel mixture passage (24) for supplying the air/fuel mixture (M) to the scavenging passage (31), and an auxiliary air introducing passage (70) for introducing an auxiliary air to the air/fuel mixture passage (24) at a location downstream of the valve unit (51, 50) in the air/fuel mixture passage (24).

11 Claims, 11 Drawing Sheets

TWO-STROKE CYCLE COMBUSTION ENGINE OF AIR SCAVENGING TYPE

BACKGROUND OF THE INVENTION

1. Field of the Invention

The present invention relates to a two-stroke cycle combustion engine of an air scavenging type which may be used as a drive source for a portable work machine such as, for example, a brush cutter.

2. Description of the Prior Art

The two-stroke cycle combustion engine of a scavenging type has been well known, in which air used for leading scavenging is supplied into the combustion chamber after it has been temporarily introduced into a leading portion of the scavenging passage during the scavenging stroke. In this combustion engine, in order to secure a stabilized rotation during the idling condition, an air valve in the air passage is closed and only the air/fuel mixture is introduced into the crank chamber from an air/fuel mixture passage so that the air/fuel mixture of an optimum concentration can be supplied from the scavenging passage into the combustion chamber during the idling condition. On the other hand, if a rapid acceleration is performed from the idling condition to a full throttle condition, an air valve is brought to a fully opened condition at once.

In this respect, because of a low speed rotation taking place with a mixture valve in the air/fuel mixture passage fully opened, the negative pressure at the venturi tube within the carburetor is low and, therefore, the amount of the air/fuel mixture supplied from the carburetor towards the crank chamber is still insufficient. Accordingly, the air/fuel mixture pooled within the crank chamber is substantially supplied to the combustion chamber. But since a substantial amount of a scavenging air is introduced into the combustion chamber immediately after the full opening of the throttle, the air/fuel mixture tends to be leaned within the combustion chamber. For this reason, at the time the engine operating condition begins to change from the idling condition to the rapid accelerating condition, the air/fuel mixture of a concentration required for the rapid acceleration will not be supplied to the combustion chamber and, therefore, an acceleration failure and/or a failure of the combustion engine to rotate is apt to occur.

In view of the above, it may be contemplated to use, during the idling condition, the air/fuel mixture which has been leaned beforehand, but this appears to result in an increase of the idling opening, accompanied by opening of the air valve by which air enters into the combustion chamber in a quantity enough to render the rotation to be instable. Also, where a start operating mechanism of a lift-up type is employed in which a needle valve is lifted to increase a fuel supply, the amount of lift decreases in a quantity corresponding to the increase of the idling opening and, therefore, the air/fuel mixture during the start of operation of the combustion engine will not be enriched sufficiently, resulting in reduction in engine startability.

In contrast thereto, the two-stroke cycle combustion engine has been suggested of a design, in which an auxiliary passage for supplying a leading air to the scavenging passage during full opening or minimum opening of the air valve is employed in the air passage so that the amount of air in the air/fuel mixture can be reduced in a quantity corresponding to the amount of air flowing through the auxiliary passage during the idling condition to thereby allow the air/fuel mixture of an enriched concentration to be supplied into the crank chamber (See, for example, the Patent Document 1 listed below). In this two-stroke cycle combustion engine, since the amount of the air flow in the air/fuel mixture passage is reduced in a quantity corresponding to the amount of air flowing through the auxiliary passage during the idling condition, the concentration of the air/fuel mixture flowing within the air/fuel mixture passage tends to increase.

Accordingly, despite that during the idling condition, the respective amounts of air and fuel to be introduced into the combustion engine are set to values substantially equal to those hitherto employed, the air/fuel mixture, which is more enriched than that hitherto employed, is supplied to the combustion chamber at the time the engine operating condition begins to change from the idling condition to the rapid accelerating condition. In view of this, even if this air/fuel mixture is leaned in admixture of a portion of the leading air, the concentration of the air/fuel mixture supplied into the combustion chamber is maintained at a value required for the rapid acceleration and, therefore, the combustion engine can be smoothly accelerated.

[Patent Document 1] JP Laid-open Patent Publication No. 2007-239463

The two-stroke cycle combustion engine disclosed in the Patent Document 1 referred to above has, however, been found having such a problem that since the flow within the auxiliary passage and the mixture passage, where the mixture valve is disposed, relies on the negative pressure developed inside the crank chamber and, during the idling condition, the air flows into the air passage through the auxiliary passage and the amount of air flowing through the mixture throttle valve tends to change under the influence of air flowing through the auxiliary passage. Accordingly, the amount of fuel to be supplied, which is determined depending on the amount of air flowing through the mixture valve, tends to fluctuate, resulting in reduction in rotational stability of the combustion engine during the idling condition.

SUMMARY OF THE INVENTION

In view of the foregoing, the present invention is intended to provide a two-stroke cycle combustion engine of an air scavenging type, in which not only can transit from the idling condition to the rapid accelerating condition take place smoothly, but the combustion engine can be favorably started.

In order to accomplish the foregoing object of the present invention, there is provided a two-stroke cycle combustion engine of an air scavenging type in which an air/fuel mixture and an air are introduced into a combustion chamber through a scavenging passage, which engine includes a valve unit for adjusting the opening of each of an air passage for supplying the air to the scavenging passage and an air/fuel mixture passage for supplying the air/fuel mixture to the scavenging passage; and an auxiliary air introducing passage for introducing an auxiliary air to the air/fuel mixture passage at a location downstream of the valve unit. The air referred to above is preferably introduced into the combustion chamber prior to introduction of the air/fuel mixture into the combustion chamber.

With the two-stroke cycle combustion engine according to the present invention, the auxiliary air flowing through the auxiliary air introducing passage can be introduced at a location downstream portion of the air/fuel mixture passage with respect to the direction of flow of the air/fuel mixture towards the combustion chamber. Therefore, the opening of the air/fuel mixture passage during the idling condition can be reduced to allow the air/fuel mixture to be enriched by, for example, adjusting a needle valve for setting the fuel flow in a quantity corresponding to the amount of the air so introduced during the idling condition. Since the amount of the air entering the combustion chamber is the sum of the air flowing through the air/fuel mixture passage and the air flowing through the auxiliary air introducing passage, the total amount of the air is increased. But if the amount of fuel is increased to a value required to achieve the number of idling revolutions about equal to that afforded by the conventional combustion engine, the air/fuel mixture within the combustion chamber will not be too enriched. Accordingly, at the time transit from the idling condition to the rapid acceleration is initiated, the air/fuel mixture pooled within the crank chamber during the idling condition can be supplied into the combustion chamber and, therefore, the combustion engine of the present invention can be accelerated rapidly. Also, since the throttle opening during the idling condition can be reduced as compared with that in the conventional combustion engine, the air passage will not be open large by the valve unit and, therefore, revolution of the combustion engine of the present invention can be stabilized.

Also, since the opening of the air/fuel mixture passage or the throttle opening can be reduced, a start operating mechanism, for example, of a lift-up type may be operated so that the lift-up amount is increased to enrich the air/fuel mixture thereby to improve the startability.

In a preferred embodiment of the present invention, the auxiliary air introducing passage may have a downstream portion defined in a spacer which is disposed between a carburetor, having the valve unit, and an engine body. This is particularly advantageous that since the downstream portion of the auxiliary air introducing passage is defined in the spacer having a plenty of available space as compared with the carburetor, positioning of the downstream of the auxiliary air passage can be facilitated.

In another preferred embodiment of the present invention, the auxiliary air introducing passage referred to above may have a throughhole defined in the carburetor for introducing a clean air, which has passed through an air cleaner, into the air/fuel mixture passage. This is particularly advantageous in that with no need to employ any extra member, and merely with the carburetor being modified or altered in any way whatsoever, the auxiliary air introducing passage can be readily formed.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Figure 1:
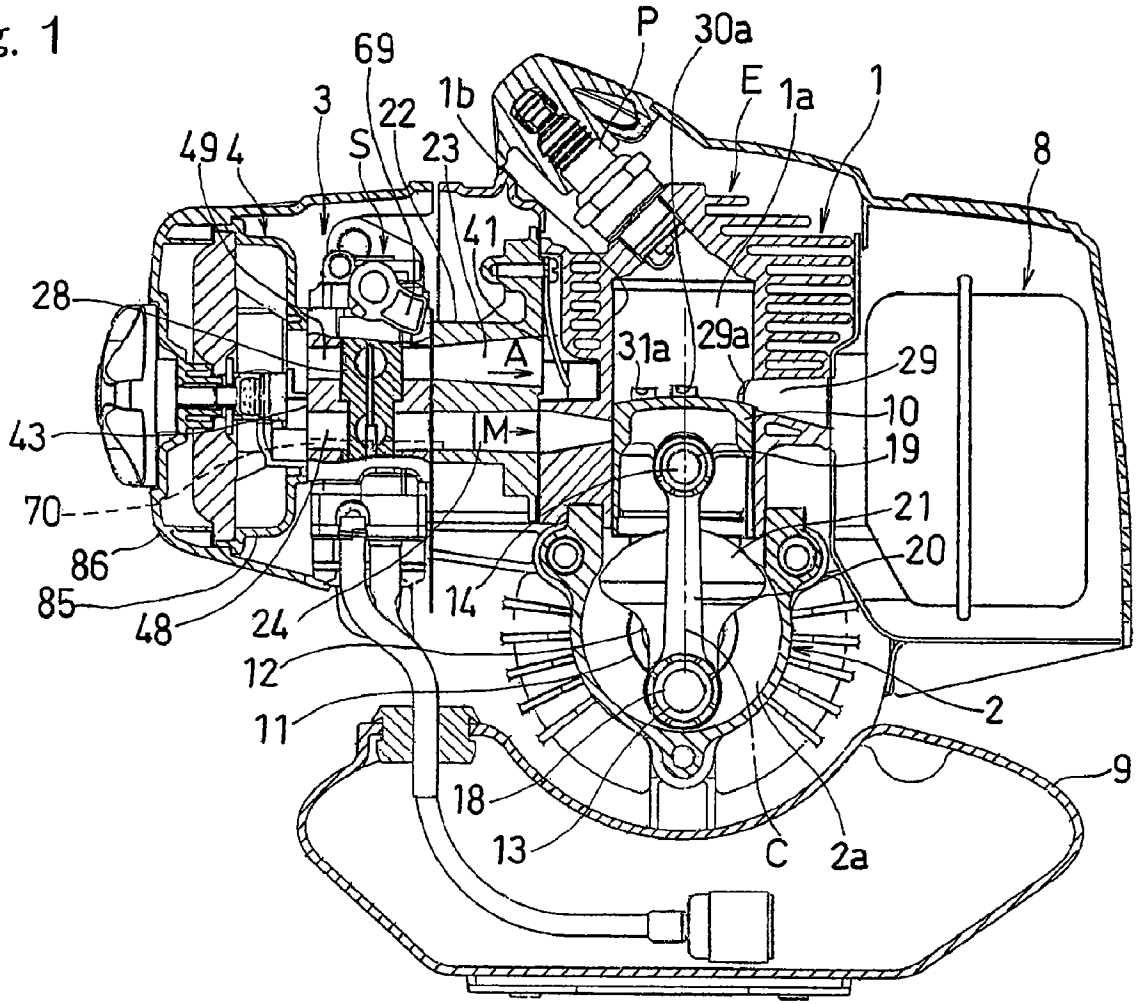
FIG. 1 is a front sectional view showing a two-stroke cycle combustion engine of an air scavenging type according to a first preferred embodiment of the present invention.

Hereinafter, some preferred embodiments of the present invention will be described in detail with particular reference to the accompanying drawings. A two-stroke cycle combustion engine of an air scavenging type according to a first preferred embodiment of the present invention, shown in FIG. 1, includes an engine body comprised of a cylinder block 1, having a combustion chamber 1*a* defined therein, and a crankcase 2 with the cylinder block 1 fixedly mounted atop the crankcase 2. The cylinder block 1 has one side portion (a left side portion) connected with a carburetor 3 and an air cleaner 4, both forming respective part of a fuel intake system, and also has the opposite side portion (the right side portion) connected with a muffler 8, forming a part of an exhaust system, and the crankcase 2 has a fuel tank 9 fitted to a lower portion thereof. The cylinder block 1 has a cylinder bore 1*b* defined therein, in which a reciprocating piston 10 is accommodated for movement in a direction conforming to the longitudinal axis C thereof, which may be a vertical direction as viewed in FIG. 1. The crankcase 2 has a crankshaft 12 drivingly supported therein by means of bearing units 11.

A hollow crank pin 13 is disposed at a location offset from the longitudinal axis of the crankshaft 12, and the crank pin 13 and a hollow piston pin 14 carried by the reciprocating piston 10 are drivingly connected together by means of a connecting rod 20 through a large diameter end bearing unit 18 and a reduced diameter end bearing unit 19. The crankshaft 12 is formed with crank webs 21, and an ignition plug P is mounted on a top portion of the cylinder block 1.

Figure 2:
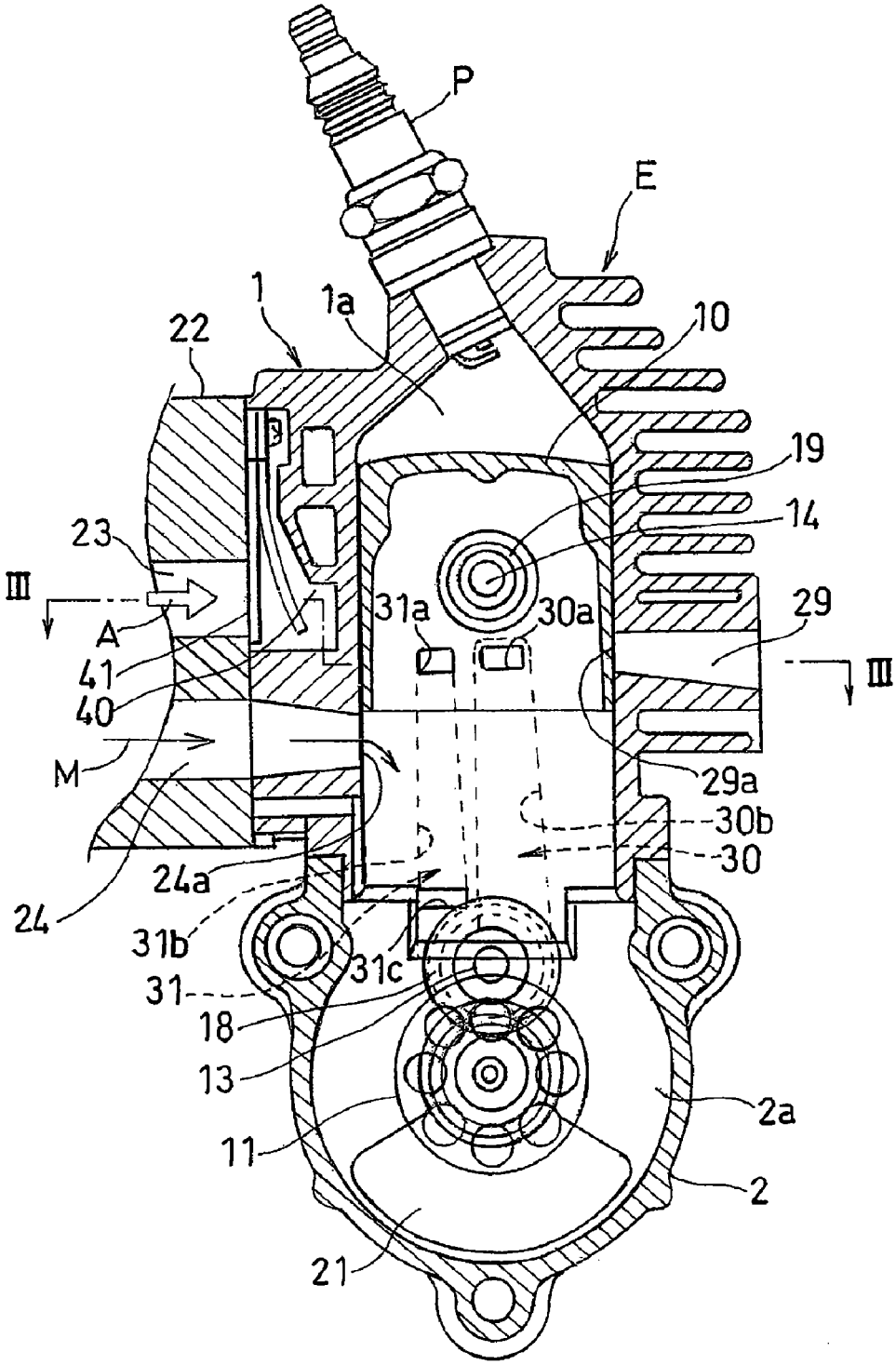
FIG. 2 is a front sectional view showing, on an enlarged scale, a cylinder block of the combustion engine and a crankcase employed therein.

Referring now to FIGS. 1 and 2, for the purpose of thermal insulation from the cylinder block 1 tending to exhibit an elevated temperature, an insulator 22, which serves as a spacer, is interposed between the cylinder block 1 and the carburetor 3. This insulator 22 has an air passage 23 formed therein at an upper portion thereof and also with a air/fuel mixture passage 24 formed therein at a lower portion thereof so as to extend substantially parallel to the air passage 23. The carburetor 3 includes a single rotary valve unit 28 for adjusting the sectional area of both of the air passage 23 and the air/fuel mixture passage 24. Also, the cylinder block 1 has a peripheral wall having an exhaust passage 29 defined therein, which exhaust passage 29 has an exhaust port 29*a* defined in the peripheral wall of the cylinder block 1 so as to open at an inner peripheral surface thereof so that exhaust gases (combustion gases) flowing through the exhaust passage 29 can be exhausted to, for example, the atmosphere through the muffler 8.

As best shown in FIG. 2, an air/fuel mixture scavenging passage 31 communicating a portion of the combustion chamber 1*a* above the reciprocating piston 10 directly with a portion of the crank chamber 2*a* below the reciprocating piston 10 is defined in part within the cylinder block 1 and in part within the crankcase 2. On the other hand, an air scavenging passage 30 for communicating the combustion chamber 1*a* with the crank chamber 2*a* through the bearing units 11 for supporting the crankshaft 12 is defined in part within the cylinder block 1 and in part within the crankcase 2 so as to be positioned adjacent the exhaust port 29*a*, but remote from the air/fuel mixture scavenging passage 31.

Also, an air/fuel mixture scavenging port 31*a*, defined at an upper end of the air/fuel mixture passage 31, and an air scavenging port 30*a*, defined at an upper end of the air scavenging passage 30, are so designed and so positioned that the air scavenging port 30*a* may have an upper end edge thereof held at a level higher than a similarly upper end edge of the air/fuel mixture scavenging port 31*a* and lower than an upper end edge of the exhaust port 29*a*. Accordingly, during the scavenging stroke, scavenging with the air A can take place prior to that with the air/fuel mixture M. It is, however, to be noted that the air scavenging port 30 may have its upper end edge held in flush with or at a level somewhat lower than the upper end edge of the air/fuel mixture scavenging port 31*a*. It is also to be noted that in FIG. 2, the connecting rod 20 shown in FIG. 1 is not shown for the sake of clarity.

The air passage 23 and the exhaust passage 29 lie on the substantially same line passing the cylinder longitudinal axis C when viewed in a direction conforming to such axis C, as shown in FIG. 1, whereas the air/fuel mixture scavenging passage 31 and the air scavenging passage 30 are employed each in a pair in symmetrical relation about a longitudinal axis C1 of the air passage 23 or a longitudinal axis C2 of the exhaust passage 29. The air/fuel mixture scavenging passage 31 and the air scavenging passage 30 are partitioned from each other by means of a substantially vertically extending partition wall 32. An air introducing port 42 operable to introduce the air A from the air introducing passage 40 therethrough into the air scavenging passage 30 is defined in a passage wall of the air/fuel mixture scavenging passage 31 remote from the combustion chamber 1*a*.

The air A from the air passage 23 defined in the insulator 22 is temporarily introduced into the air scavenging passage 30 through the air introducing passage 40 in the cylinder block 1 by the effect of a negative pressure developed within the crank chamber 2*a* shown in FIG. 2 during the intake stroke with the reciprocating piston 10 then ascending. On the other hand, the air/fuel mixture M from the air/fuel mixture passage 24 is directly introduced into the crank chamber 2*a* by way of an air/fuel mixture port 24*a*, defined in an inner peripheral surface of the cylinder block 1, by the effect of the negative pressure developed within the crank chamber 2*a* during the intake stroke with the reciprocating piston 10 then ascending.

Figure 3:
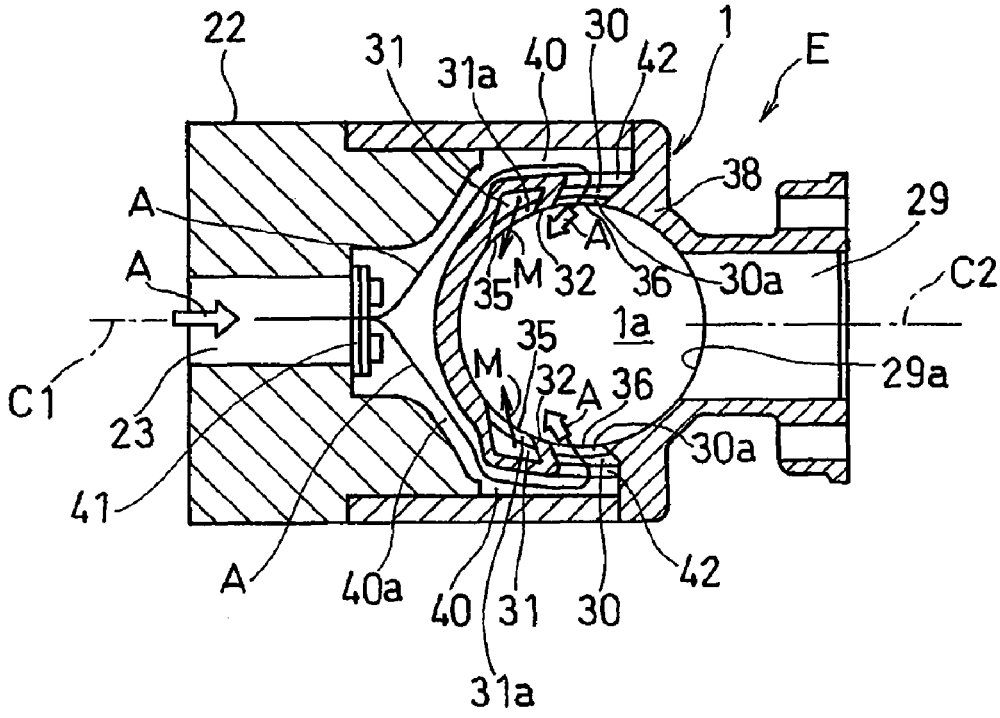
FIG. 3 is a cross sectional view taken along the line III-III in FIG. 2.

Referring to FIG. 3, the air passage 23 defined in the insulator 22 has a downstream exit port defined therein and provided with a reed valve 41 fitted thereto. This reed valve 41 is so designed and so operable that when the pressure inside the air introducing passage 40 continued from the downstream exit port of the air passage 23 increases to a value higher than a predetermined pressure, the air passage 23 can be closed. The air A for scavenging purpose flowing from the air passage 23 is introduced into the air scavenging passage 30 through the air introducing passage 40 and the air introducing port 42 when the reed valve 41 is in an open position to open the air passage 23.

The air/fuel mixture scavenging passage 31 best shown in FIG. 2 includes the air/fuel mixture scavenging port 31*a* open at the inner peripheral surface of the cylinder block 1, a communicating passage 31*b* defined in part in a lower portion of the cylinder block 1 and in part in an upper portion of the crankcase 2 across the joint between the cylinder block 1 and the crankcase 2 so as to extend downwardly from the air/fuel mixture scavenging port 31*a* in a direction towards the upper portion of the crankcase 2, and an inflow port 31*c* open at an inner peripheral surface of that upper portion of the crankcase 2. A cylinder inner diametric side of the communicating passage 31 referred to above is covered by an air/fuel mixture scavenging passage wall 35 best shown in FIG. 3, and the air/fuel mixture scavenging port 31*a* is defined in an upper portion of the air/fuel mixture scavenging passage wall 35 while the inflow port 31*c* referred to above is defined in a lower portion of the air/fuel mixture scavenging passage wall 35. The air/fuel mixture M introduced from the air/fuel mixture passage 24 into the crank chamber 2*a* is, during the scavenging stroke with the reciprocating piston 10 then descending, jetted in a direction diagonally upwardly from the air/fuel mixture scavenging port 31*a* towards the combustion chamber 1*a* through the communicating passage 31*b*.

On the other hand, the air scavenging passage 30 includes the air scavenging port 30*a* open at the inner peripheral surface of the cylinder block 1 and a communicating passage 30*b* defined in part in the lower portion of the cylinder block 1 and in part in the upper portion of the crankcase 2 across the joint between the cylinder block 1 and the crankcase 2 so as to extend downwardly from the air scavenging port 30*a* in a direction towards outer side faces of the crank bearing units 11, which is located in a portion of the crankcase 2 intermediate of the height of the latter. A cylinder inner diametric side of the communicating passage 30*b* referred to above is covered by an air scavenging passage wall 36, and the air scavenging port 30*a* referred to previously is defined in an upper portion of the air scavenging passage wall 36. This communicating passage 30*b* best shown in FIG. 2 has a lower end communicated with the crank chamber 2*a* through a gap between inner and outer rings of each of the bearing units 11 and then through a gap between the bearing units 11 and the adjacent crank webs 21.

The air A introduced into the air scavenging passage 30 from the air passage 23, shown in FIG. 3, through the air introducing passage 40 is, during the scavenging stroke with the reciprocating piston 10 then descending, jetted in a direction diagonally upwardly from the air scavenging port 30*a* towards the combustion chamber 1*a* through the communicating passage 30*b*. Accordingly, the air A shown in FIG. 3 serves to block the air/fuel mixture M, thereby effectively suppressing an undesirable blow-off of the air/fuel mixture M from the exhaust passage 29 to the atmosphere.

The two-stroke cycle combustion engine of the structure described hereinabove operates in the following manner. During the intake stroke, as the reciprocating piston 10 then ascending within the cylinder bore 1*b* in the cylinder block 1 approaches a position adjacent the top dead center, accompanied by a negative pressure developed inside the crank chamber 2*a* and the cylinder block 1 below the piston 10, the air/fuel mixture M is directly introduced into the crank chamber 2*a* from the air/fuel mixture port 24*a* open at the inner peripheral surface of the cylinder block 1. Since at this time, a negative pressure is developed also in the air scavenging passage 30 communicated with the crank chamber 2*a* through the bearing units 11, the pressure inside the air introducing passage 40 shown in FIG. 3 and communicated with the air scavenging passage 30 is reduced to a negative value and the reed valve 41 fitted to the exit of the air passage 23 in the insulator 22 is accordingly opened to allow the air A from the air passage 23 to be introduced temporarily into the air scavenging passage 30 through the air introducing passage 40.

In this way, during the intake stroke, the air A is introduced into the air scavenging passage 30 at all times when the reed valve 41 is opened by the effect of the negative pressure inside the crank chamber 2*a* shown in FIG. 2. For this reason, a sufficient amount of air necessary to avoid the undesirable blow-off can be secured within the air scavenging passage 30.

Thereafter, and during the scavenging stroke, the air A is introduced into the combustion chamber 2*a* from the air scavenging port 30*a* open at the inner peripheral surface of the cylinder block 1 at a somewhat high level as shown in FIG. 3 and, a short moment later, the air/fuel mixture M is introduced into the combustion chamber 2*a* from the air/fuel mixture scavenging port 31*a*. Because of such introducing timing and, also, because the air A is introduced into the combustion chamber 1*a* from a location nearer the exhaust port 29*a* than a location from which the air/fuel mixture M is introduced, exhaust gases can be pushed out and discharged from the exhaust port 29*a* by the air A that has been introduced earlier than the air/fuel mixture M. Accordingly, the undesirable blow-off of the air/fuel mixture M from the exhaust gases 29*a* can be avoided.

Figure 4:
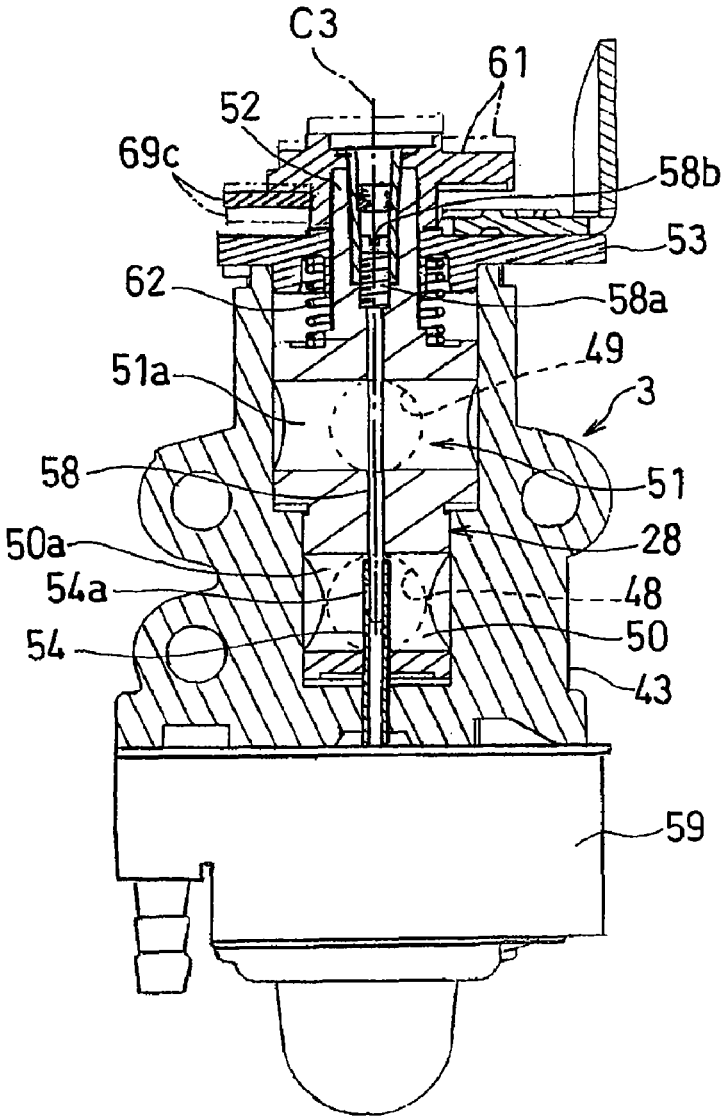
FIG. 4 is a side sectional view showing a carburetor employed in the combustion engine.

In the description that follows, the structure according to the gist of the first preferred embodiment of the present invention will be discussed. As shown in FIG. 1, the carburetor 3 has a carburetor body 43 having a carburetor air/fuel mixture passage 48 defined therein for supplying the air/fuel mixture M towards the engine body E and a carburetor air passage 49 defined therein for supplying the scavenging air A towards the engine body E so as to extend parallel to the carburetor air/fuel mixture passage 48. The carburetor body 43 includes the single rotary valve unit 28 supported thereby so as to extend across the passages 48 and 49 in a direction substantially perpendicular thereto for pivotal movement. As best shown in FIG. 4, the rotary valve unit 28 includes an air/fuel mixture valve 50 for adjusting the opening of the carburetor air/fuel mixture passage 48 and an air valve 51 formed integrally and coaxially with the air/fuel mixture valve 50 for adjusting the opening of the carburetor air passage 49.

More specifically, the air/fuel mixture valve 50 and the air valve 51 have an air/fuel mixture flow aperture 50*a* and an air flow aperture 51*a*, which are defined therein, respectively, for adjusting the respective openings of the carburetor air/fuel mixture passage 48 and the carburetor air passage 49. Those valves 50 and 51 are pivotable about the longitudinal axis C3 extending in a direction substantially perpendicular to the passages 48 and 49 for adjusting the respective openings of the passages 48 and 49.

The rotary valve unit 28 has an upper surface formed with a valve shaft 52 so as to project coaxially therefrom, which shaft 52 extends through a lid member 53 closing an upper open end of the carburetor body 43 and is then rotatably supported by such lid member 53. The carburetor body 43 is provided with a main nozzle 54 for a fuel (gasoline) extending coaxially through a bottom portion of the air/fuel mixture valve 50 so as to project into the air/fuel mixture aperture 50*a*, and a fuel injecting port 54*a* shown in FIG. 5 is defined in a portion of a peripheral wall of the main nozzle 54.

On the other hand, a needle valve 58 extends coaxially with the rotary valve unit 28 to the air/fuel mixture aperture 50*a* in the air/fuel mixture valve 50 through the hollow of the valve shaft 52, and this needle valve 58 has an upper end 58*a* formed with a male thread that is threaded into an internally threaded hole 52*a* defined in the valve shaft 52. The needle valve 58 has a minus (−) shaped groove 58*b* defined in a top face thereof so that when the needle valve 58 is turned with a screw driver engaged in the minus shaped groove 58*b*, the needle valve 58 can be moved up or down relative to the rotary valve unit 28 to thereby adjust the opening of the fuel injecting port 54*a* of the main nozzle 54, that is, adjust the amount of fuel injected. This needle valve 58 has a lower end inserted into the main nozzle 54.

Figure 5:
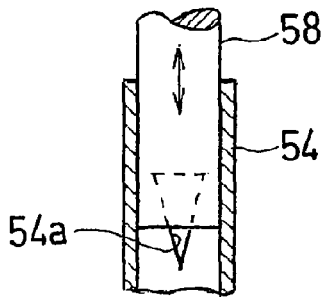
FIG. 5 is an enlarged sectional view showing a main nozzle and a needle valve employed in the carburetor.

As best shown in FIG. 5, the fuel injecting port 54*a* of the main nozzle 54 is formed in a shape similar to the shape of the elongated, but inverted triangle so that the opening of the fuel injecting port 54*a*, that is, the opening of the main nozzle 54 can be adjusted by the needle valve 58 then moving upward or downward. Also, a coil spring 62 is interposed between an upper face of the air valve 51 and a lower surface of the lid member 53 so that the rotary valve unit 28 can be returned from a throttle full open position to an idling opening by the effect of a spring force thereof.

Figure 6:
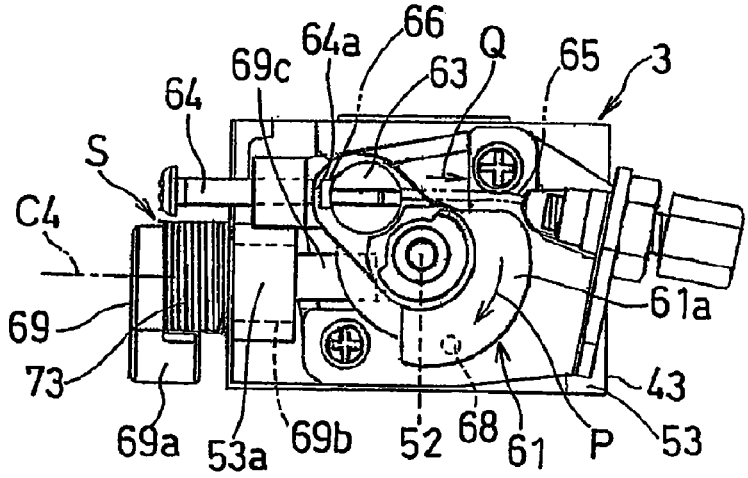
FIG. 6 is a top plan view showing the carburetor employed in the combustion engine.

A fuel reserving body 59 having a diaphragm pump (not shown) built therein is connected with a bottom region of the carburetor body 43 and the fuel can be supplied from this fuel reserving body 59 to the main nozzle 54. The valve shaft 52 has an upper end portion extending upwardly through the lid member 53 and a valve operating lever 61 is connected with that upper end portion of the valve shaft 52. As shown in FIG. 6, the valve operating lever 61 has a cam portion 61*a* of a sector shape as viewed from top and also has an intermediate portion, which is a root portion thereof, fixed to the valve shaft 52. A cylindrical connecting member 63 is provided in an end portion of the valve operating lever 61 remote from the cam portion 61 so as to protrude therefrom. A remote operating cable 65 having one end connected with a manually operated throttle lever (not shown) has the opposite end provided with an engagement member 66 that is connected with the connecting member 63. The valve operating lever 61 is applied a rotary restoring force from the coil spring 62 shown in FIG. 4 and is accordingly normally biased in a direction counter to the arrow headed line P so that the valve operating lever 61 can be maintained at a position where it is held in engagement with a free end 64*a* of an adjustment bolt 64 during the idling condition.

Figure 7:
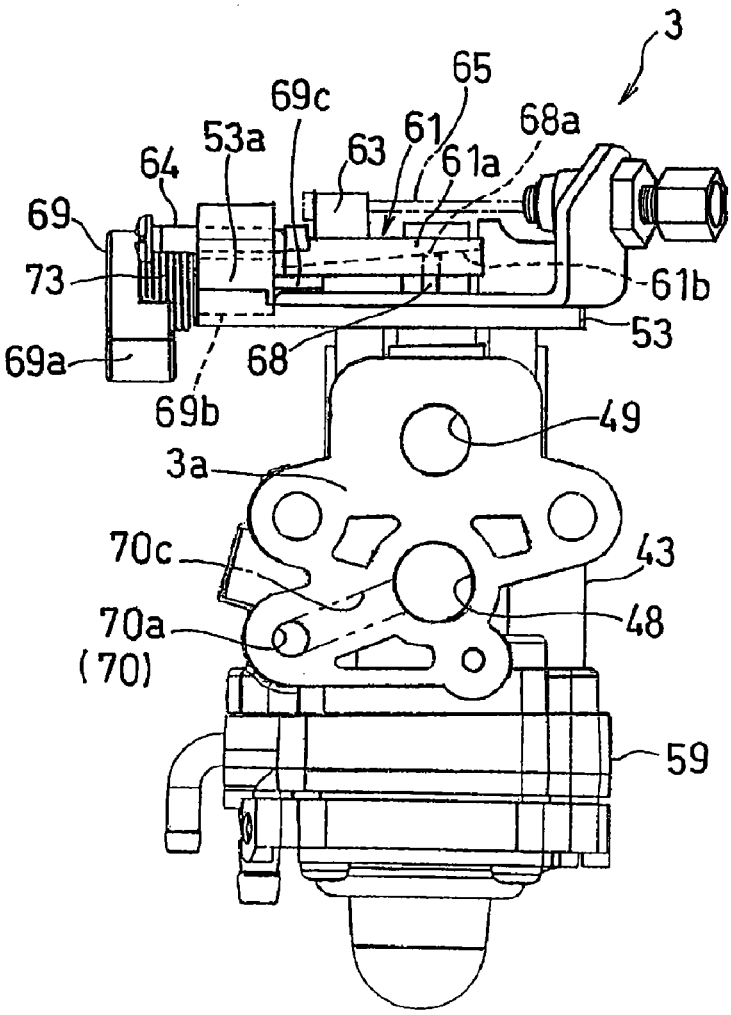
FIG. 7 is a front elevational view showing the carburetor employed in the combustion engine.

As best shown in FIG. 7, the cam portion of the valve operating lever 61 has a cam surface 61 defined in a lower surface thereof, with which an upper end 68*a* of a guide pin 68 projecting from the lid member 53 is held in contact. In other words, the cam surface 61*b* is applied an elastic force by the effect of a restoring force of the coil spring 62, shown in FIG. 4, acting on the valve shaft 52, so as to be oriented downwardly and is therefore held in contact with the upper end of the cam guide pin 68. Accordingly, when the connecting member 63 is pulled in a direction shown by the arrow headed line Q, shown in FIG. 6, through the remote operating cable 65, the cam portion 61*a* of the valve operating lever 61 pivots in the direction shown by the arrow headed line P in the manner hereinabove described, with the cam surface 61*b* held in sliding contact with the cam guide pin 68 as shown in FIG. 7, and, therefore, the valve operating lever 61 is pulled upwards against the resilient force of the coil spring 62 shown in FIG. 4. At this time, the rotary valve unit 28 shown in FIG. 4 is pivoted together with the valve operating lever 61 to thereby adjust the respective openings of the carburetor air/ fuel mixture passage 48 and the carburetor air passage 49 to a large value by means of the associated apertures 50*a* and 51*a*, shown in FIG. 4, of the air/fuel mixture valve 50 and the air valve 51. Simultaneously therewith, the needle valve 58 ascends together with the valve operating lever 61 to increase the opening of the fuel injecting port 54*a* with a substantial amount of fuel consequently supplied to the carburetor air/fuel mixture passage 48. In this way, the combustion engine is controlled as to its revolution in dependence on manipulation of the throttle lever.

The carburetor 3 is provided with a lift-up type start operating mechanism S shown in FIG. 6. This start operating mechanism S includes a lift up lever 69 having its left end (as viewed in FIG. 6) provided with an operating portion 69*a*, and a shank portion 69*b* on the right side of the lift up lever 69. The shank portion 69*b* is inserted into a bearing unit 53*a* disposed at a position of a left end, as viewed in FIG. 6, of the lid member 53 so that the lift-up lever 69 is supported for pivotal movement about the longitudinal axis C4 of the lever 69. An actuating piece 69*c* is provided at a free end of the shank portion 69*b* of the lift up lever 69 so as to project therefrom and is held in contact with the lower surface of the cam portion 61*a* of the valve operating lever 61.

The actuating piece 69*c* referred to above is in the form of a flat plate as best shown in FIGS. 6 and 7. Accordingly, when at the time the combustion engine is to be started, the lift up lever 69 is manually pivoted 90° from a stop position by the effect of a pivoting operation of the operating portion 69*a*, the actuating piece 69*c* is lifted upwardly to push the valve operating lever 61 upwardly as shown by the double dotted line in FIG. 4. Accordingly, the rotary valve unit 28 and the needle valve 58 are elevated together with the valve operating lever 61 to increase the opening of the fuel injecting port 54*a* of the main nozzle 54 to increase the amount of fuel to be supplied and, consequently, a proper amount of fuel can be supplied to facilitate starting of the combustion engine.

When after the combustion engine has been started, the operating portion 69*a* best shown in FIG. 6 is manually operated to return the lift up lever 69 back to the initial position, the valve operating lever 61 then pushed upwardly by the actuating piece 69*c* in the manner described above is lowered, with the combustion engine establishing an idling condition. Also, even though the lift up lever 69 is not manually returned to the initial position, operating the throttle lever in a direction of acceleration can result in pivotal movement of the valve operating lever 61 and the rotary valve unit 28 (FIG. 4) in the direction shown by the arrow headed line P through the remote operating cable 65, with the valve operating lever 61 consequently pushed upwards by means of the guide pin 68. Therefore, when the lower surface of the valve operating lever 61 separates from the actuating piece 69*c* of the lift up lever 69, the pushing force applied from the valve operating lever 61 to the actuating piece 69 is released. As a result, the lift up lever 69 is automatically returned to the initial position, best shown in FIGS. 6 and 7, by the effect of the restoring force of a coil spring 73, which has been engaged at its opposite ends with the operating portion 69*a* and a cylindrical portion 53*a* of the bearing unit of the lid member 53, respectively, and the combustion engine is consequently brought in the idling condition.

Figure 8:
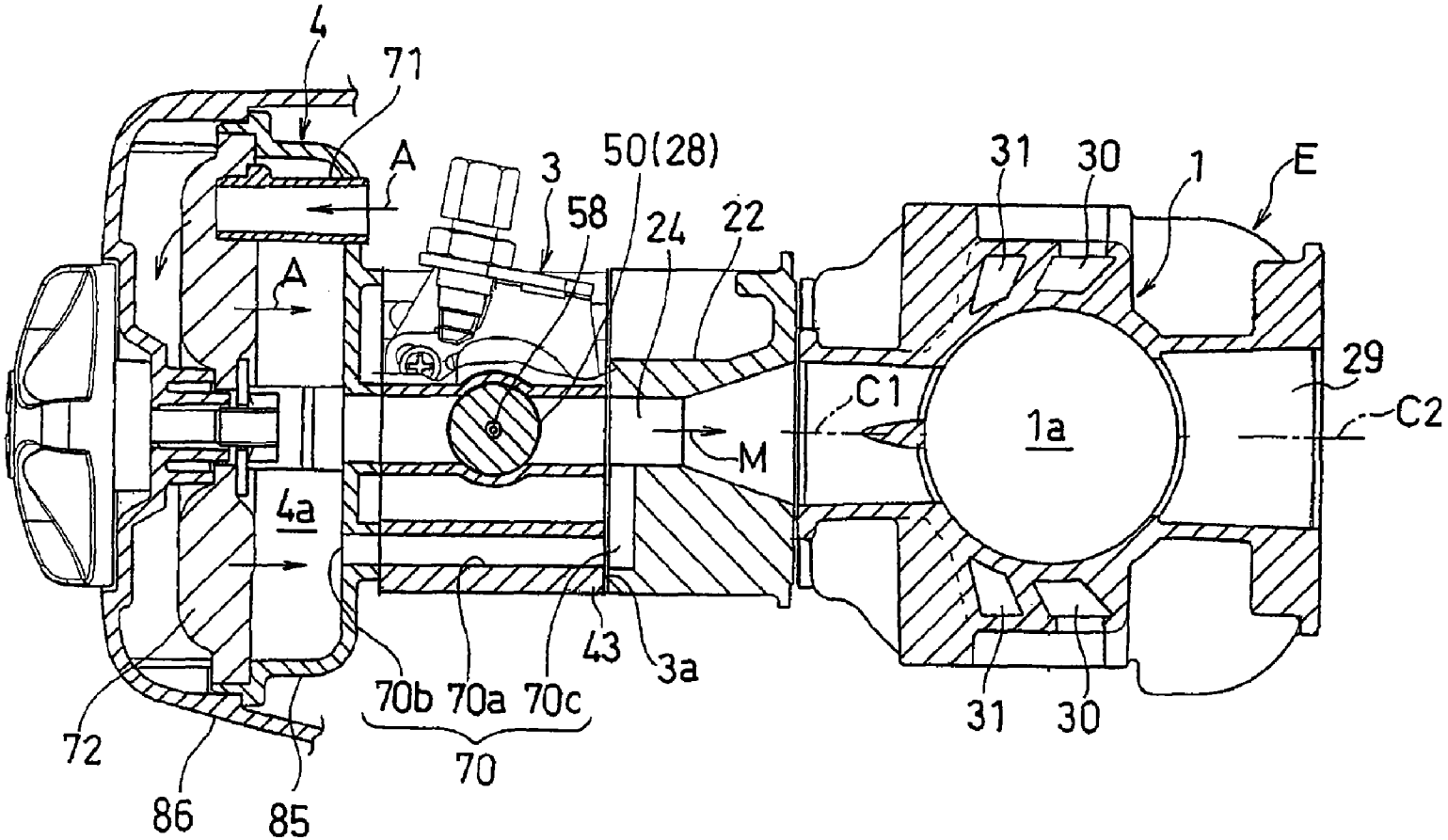
FIG. 8 is a top plan sectional view showing the combustion engine.

Referring now to FIG. 8, an auxiliary air passage 70 is formed so as to bypass the air/fuel mixture valve 50 of the rotary valve unit 28. This auxiliary air introducing passage 70 has a throughhole 70*a* defined therein as a part thereof so as to extend through the carburetor body 43 of the carburetor 3.

The air cleaner 4 referred to previously is formed with an upstream communicating hole 70*b* positioned in a clean air chamber 4*a*, which is on a clean side in the air cleaner 4, and communicated with an upstream opening of the throughhole 70*a* for the air A. Also, the insulator 22 referred to previously is formed with a communicating groove 70*c* defined therein for communicating a downstream opening of the throughhole 70*a* and the air/fuel mixture passage 24. The auxiliary air introducing passage 70 referred to above and communicating between the clean air chamber 4*a* of the air cleaner 4 and a downstream side of the rotary valve unit 28 is formed by the throughhole 70*a*, an upstream communicating hole 70*b* and a communicating hole 70*c*.

The air cleaner 4 is of a type made up of a cleaner casing 85 and a cleaner covering 86 both cooperating with each other to define a cleaner space, including the clean air chamber 4*a* referred to previously, therebetween, and a cleaner element 72 accommodated within such cleaner space. This air cleaner 4 draws an air A from the outside through an air intake tube 71, and then introduce the air A into the carburetor air/fuel mixture passage 48 and the carburetor air passage 49, both shown in FIG. 1, after the air A so drawn from the outside has been substantially purified by the cleaner element 72 and subsequently flowed into the clean air chamber 4*a*. In addition, a part of the substantially purified air within the clean air chamber 4*a* is introduced through the auxiliary air introducing passage 70 as an auxiliary air into the air/fuel mixture passage 24 on the downstream side of the rotary valve unit 28.

As hereinabove described, in the two-stroke cycle combustion engine according to the foregoing first preferred embodiment of the present invention, the use is made of the auxiliary air introducing passage 70 so that an auxiliary air A can be introduced into the air/fuel mixture passage 24 on the downstream side of the rotary valve unit 28. Accordingly, the needle valve 58 of the carburetor 3 can be shifted upwards during the idling condition to increase the amount of fuel to be supplied in a quantity corresponding to the amount of the auxiliary air so introduced, allowing the number of idling revolutions of the combustion engine to be adjusted to a value comparable to that afforded by the conventional standard combustion engine. In other words, it is sufficient to set the initial position of the air/fuel mixture valve 50 of the rotary valve unit 28 so that the opening of the air/fuel mixture valve 50 in the carburetor air/fuel mixture passage 48 is reduced so as to render the amount of the air flowing through the carburetor air/fuel mixture passage 48 small, while adjusting the needle valve 58 in the manner described above.

The amount of the air flowing into the combustion chamber 1*a* during the idling condition corresponds to the sum of the air flowing through the air/fuel mixture passage 24 and that flowing through the auxiliary air introducing passage 70. Accordingly, since the total amount of the air is increased, the amount of fuel can be increased correspondingly by determining the position of the needle valve 56 so that the number of idling revolutions of the combustion engine which may be equal to that afforded by the conventional standard combustion engine can be attained. As a result, the air/fuel mixture within the combustion chamber 1*a* will not be enriched excessively and, therefore, a smooth idling operation can be performed.

Since when transit from the idling condition to the rapid acceleration is initiated, the enriched air/fuel mixture pooled within the crank chamber 2*a* is supplied into the combustion chamber 1*a*, the rapid acceleration can be performed smoothly. Also, since the opening of the air/fuel mixture valve 50 during the idling condition, that is, the throttle opening during the idling condition can be reduced as compared with that in the conventional standard combustion engine, the opening of the air valve 51 provided in the same rotary valve unit 28 having the air mixture valve 50 can also be reduced. Accordingly, there is no possibility of the air passage to be opened large, allowing the revolution of the combustion engine to be stabilized.

Since as hereinabove described, the throttle opening during the idling condition can be reduced to a value smaller than that afforded with the conventional standard combustion engine, the release position (return position) of the lift up lever 69 for starting can be lowered. Accordingly, the lift-up amount or distance of the needle valve 58 when the lift up lever 69 is pivoted to an operating position at the time of engine start, that is, the amount of the fuel injection port 54*a* of the main nozzle 54 to be increased at the time of engine start can be increased. Considering that the fuel injecting port 54*a* of the main nozzle 54 is so shaped as to represent the inverted triangular shape as shown and described with particular reference to FIG. 5, increase of the amount of the needle valve 56 lifted up results in increase of the amount of fuel supplied and hence, the startability can be improved.

Also, in the two-stroke cycle combustion engine of the structure hereinbefore described, the communicating groove 70*c* forming a downstream portion of the auxiliary air introducing passage 70 is formed in the insulator 22 disposed between the carburetor 3 and the engine body E. Accordingly, a portion of the auxiliary air introducing passage 70 can be easily provided in the insulator 22 which has an ample space as compared with that in the carburetor 3. In addition, with no need to add any extra member, the auxiliary air introducing passage 70 can be provided if the carburetor 3, the insulator 22 and the air cleaner 4 are merely modified.

It is to be noted that as shown by the double dotted chain line in FIG. 7, the communicating groove 70*c* may be formed in a mating surface 3*a* of the insulator 22 of the carburetor 3.

Figure 9:
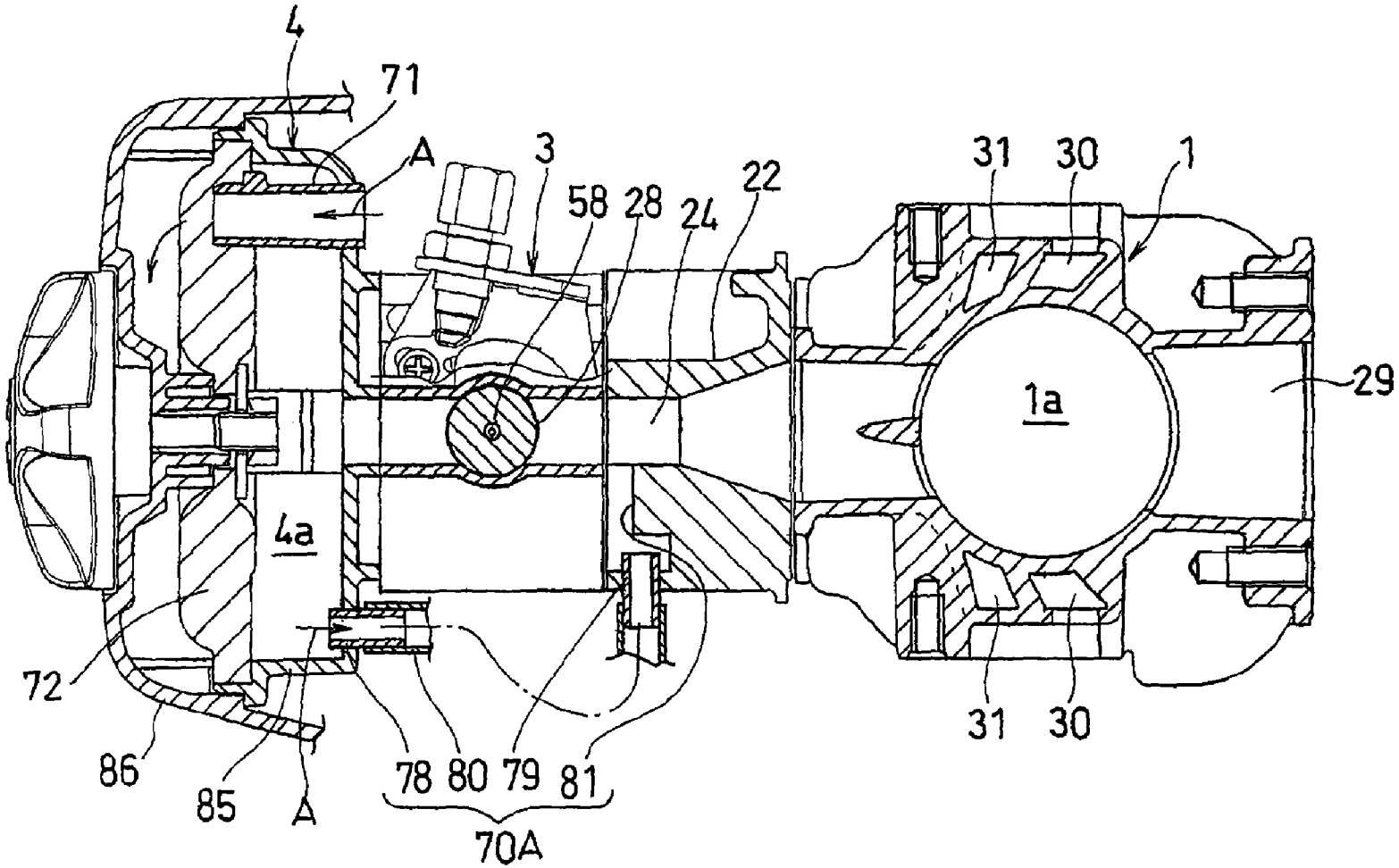
FIG. 9 is a top plan sectional view showing the two-stroke cycle combustion engine according to a second preferred embodiment of the present invention.

FIG. 9 illustrates in a top sectional representation the combustion engine according to a second preferred embodiment of the present invention. It is to be noted that component parts shown in FIG. 9, but similar to those shown particularly in FIG. 8 are designated by like reference numerals and the details are not therefore reiterated for the sake of brevity.

In the second preferred embodiment of the present invention, the auxiliary air introducing passage 70A is made up of a delivery tube 78 fitted to a wall surface of the air cleaner 4 so as to extend therethrough with one end thereof positioned inside the clean air chamber 4*a*, an inflow tube 79 fitted to the insulator 22 so as to extend thereinto from outside, a connecting tube 80 connecting the delivery tube 78 with the delivery tube 79, and a communicating groove 81 defined in the insulator 22 for communicating the inflow tube 79 with the air/fuel mixture passage 24. Accordingly, in this second embodiment of the present invention, the auxiliary air introducing passage 70A can easily provided with no need to modify the carburetor 3 for this purpose.

Figure 10:
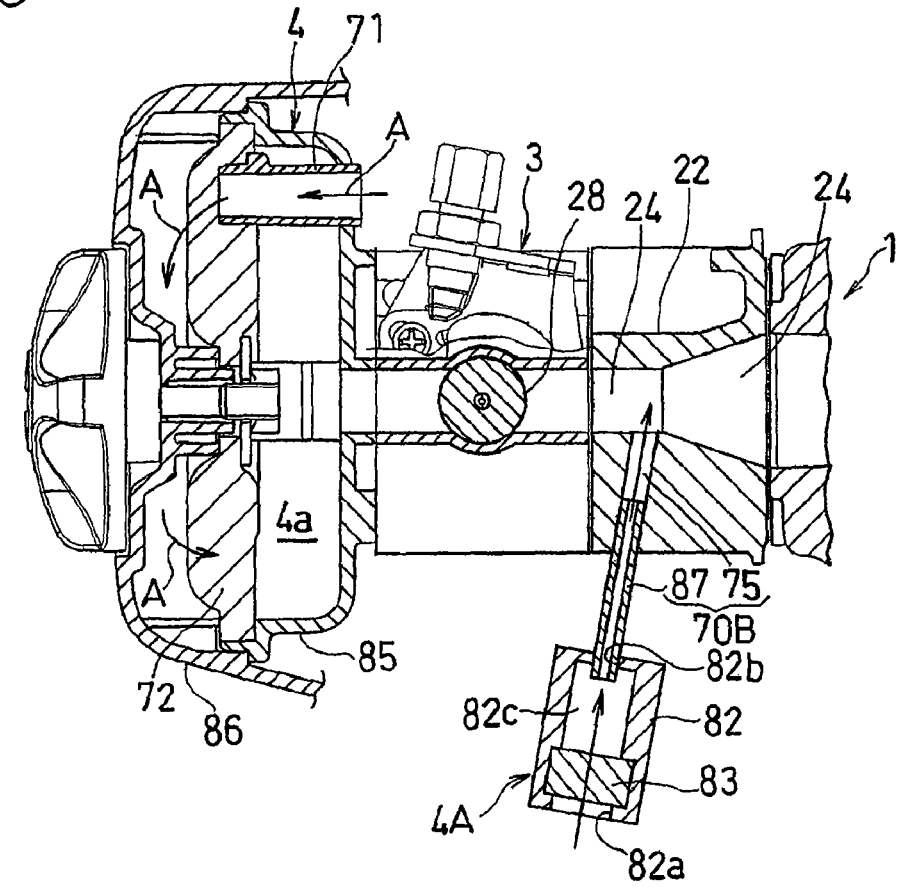
FIG. 10 is a top plan sectional view showing the two-stroke cycle combustion engine according to a third preferred embodiment of the present invention.

FIG. 10 illustrates in a top sectional representation the combustion engine according to a third preferred embodiment of the present invention. It is to be noted that component parts shown in FIG. 9, but similar to those shown particularly in FIG. 8 are designated by like reference numerals and the details are not therefore reiterated for the sake of brevity.

In the third preferred embodiment of the present invention, an auxiliary air cleaner 4A is additionally employed, which includes a compact cleaner casing 82 having an air inflow port 82*a* and an air outflow port 82*b* both defined therein and a cleaner element 83 accommodated within the interior of the cleaner casing 82 and is operable to substantially purify the external air with the cleaner element 83. An air introducing tube 87 has an upstream portion thereof fitted into the air outflow port 82*b* open into a clean air chamber 82*c* of the cleaner casing 82 and also has a downstream portion fitted into an air introducing hole 75 defined in the insulator 22 in communication with the air/fuel mixture passage 24. This air introducing tube 87 and the air introducing hole 75 altogether form an auxiliary air introducing passage 79B that connects the auxiliary air cleaner 4A with the air/fuel mixture passage 24.

Accordingly, even in this third embodiment, the auxiliary air introducing passage 70B can be provided with no need to modify the carburetor 3 for this purpose.

As discussed above, since the carburetor 3 employed in any of the embodiments shown in and described with particular reference to FIGS. 9 and 10, respectively, need not be modified or altered in anyway whatsoever as is the case with that in the second embodiment described previously, the versatility of the carburetor 3 can be expanded.

Figure 11:
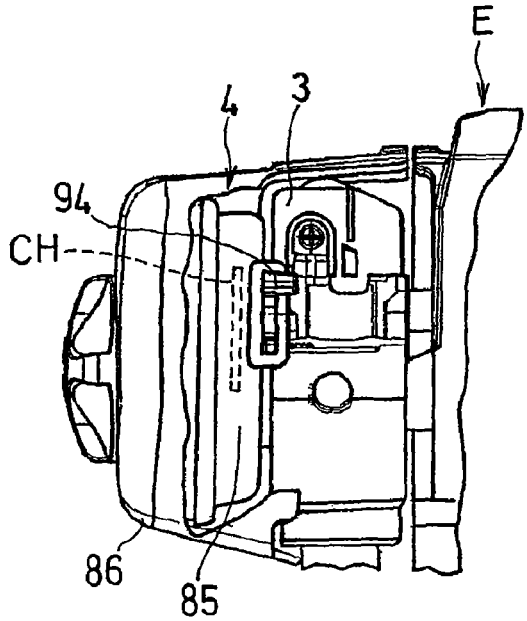
FIG. 11 is a front elevational view showing an important portion of the two-stroke cycle combustion engine according to a fourth preferred embodiment of the present invention.

The two-stroke cycle combustion engine according to a fourth preferred embodiment of the present invention is shown fragmentarily in FIG. 11 in a front elevational representation. In the fourth embodiment, as the start operating mechanism, a standard choke mechanism is employed in place of the start lift up lever 69 shown in and described with particular reference to FIG. 1.

Figure 12:
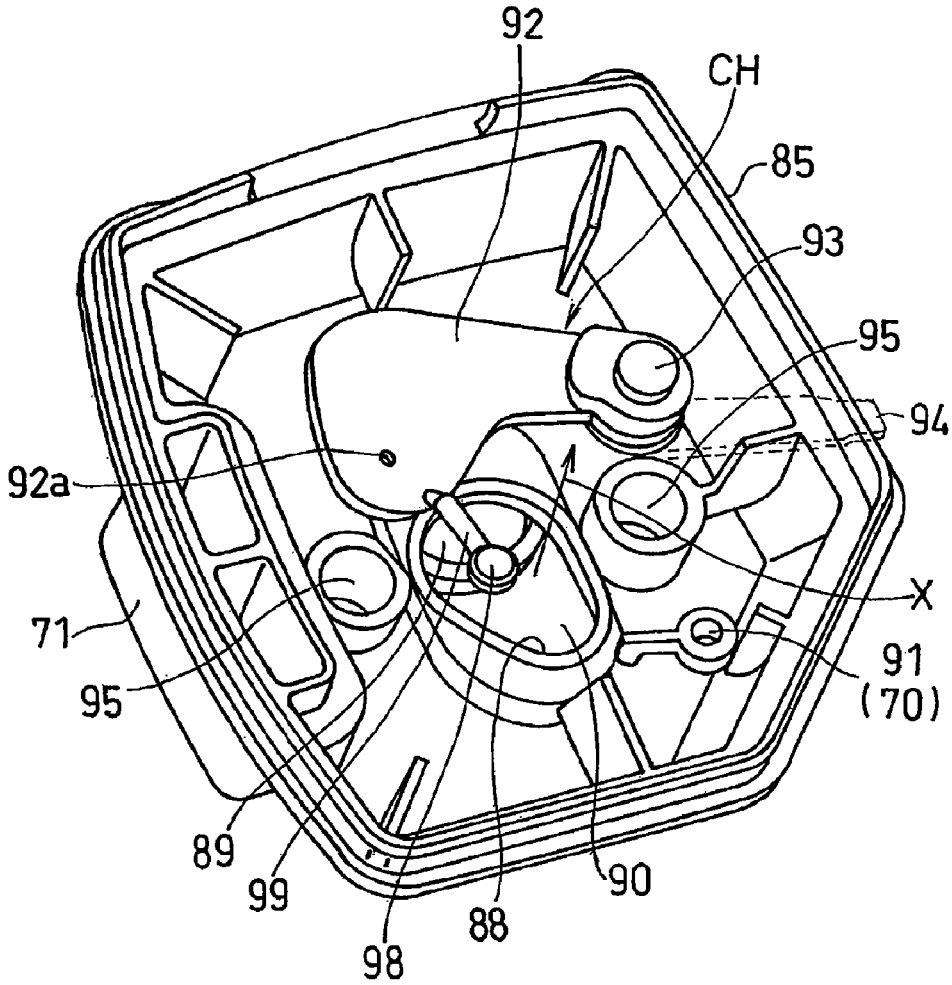
FIG. 12 is a perspective view showing a cleaner casing of an air cleaner employed in the fourth preferred embodiment.
Figure 13:
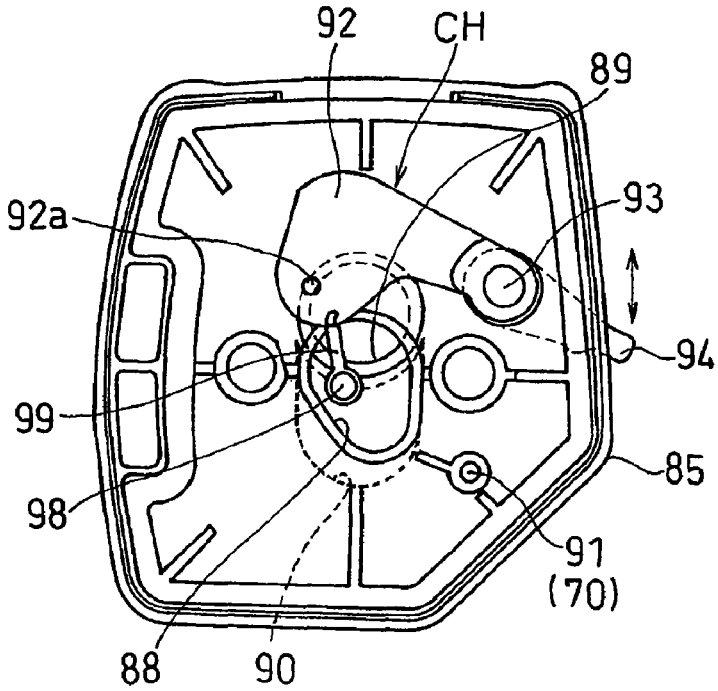
FIG. 13 is a left side view showing the cleaner casing with a choke valve shown as fully opened.

Referring now to FIG. 11, a choke valve CH is provided in the air cleaner 4. FIG. 12 illustrates a perspective representation showing the interior of the cleaner casing 85 of the air cleaner 4 and FIG. 13 illustrates a left side representation showing the cleaner casing 85. As best shown in FIG. 12, an air inflow hole 88 of a shape nearly similar to the shape of an hen egg is defined at a generally center portion of the cleaner casing 85, and an upper air delivery hole 89 and a lower air delivery hole 90 are defined in a portion of the cleaner casing 85 downstream of the air inflow hole 88 and positioned one above the other. Accordingly, air having passed through the air inflow hole 88 flows in part into the upper air delivery hole 89 and in part into the lower air delivery hole 90.

It is to be noted that reference numeral 95 represents insertion holes through which corresponding bolts (not shown) required to connect the cleaner casing 85 and the cleaner covering 86 together are passed.

As shown in FIG. 13 in the side view, the upper air delivery hole 89 represents a round shape whereas the lower air delivery hole 90 represents a modified elongated shape. The upper air delivery hole 89 serves to deliver the air to the carburetor air passage 49 best shown in FIG. 1 and the lower air delivery hole 90 deliver the air to the carburetor air/fuel mixture passage 48 also best shown in FIG. 1. Also, an auxiliary air hole 91 is defined at a location laterally of the lower air delivery hole 90 for supplying the auxiliary air towards the throughhole 70*a*, defined in the carburetor 3 and forming a major passage portion of the auxiliary air introducing passage 70, as is the case with the previously described first embodiment, or for supplying the auxiliary air towards the auxiliary air introducing passage 70A including the connecting tube 90 shown in FIG. 9, as is the case with the previously described second embodiment.

The cleaner casing 85 shown in FIG. 12 has a support pin 93 pivotally disposed therein and extending parallel to a direction X in which the air inflow hole 88 opens, and the choke valve CH is fixedly mounted on this support pin 93 for pivotal movement together with the support pin 93. This choke valve CH has a valve body 92 positioned inwardly of the cleaner casing 85, and choke lever 94 for adjustably driving the valve body 92 is fixedly connected with the support pin 93 and is positioned outside the cleaner casing 86. As best shown in FIG. 11, the choke lever 94 protrudes forwardly from the cleaner casing 85 and can be moved up and down manually to pivot the choke valve CH, best shown in FIG. 13, to thereby adjust the amount of the air to be sucked.

Although the valve body 92 of the choke valve CH so far described above is in the form of a flat plate, it may be of a rotary valve type as is the case with the rotary valve unit 28 and, in any event, it may be of any suitable construction provided that the air inflow port 88 can be selectively opened or closed.

Figure 14:
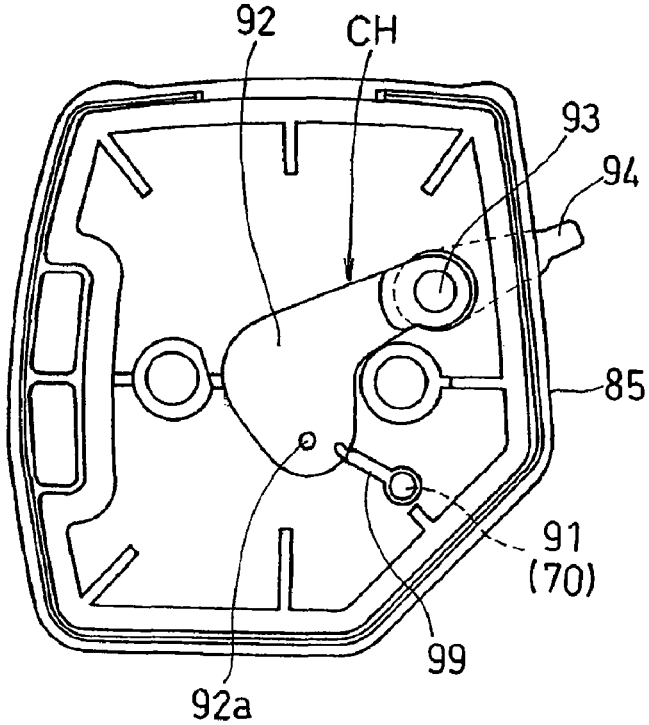
FIG. 14 is a left side view showing the cleaner casing with the choke valve shown as completely closed.

When the choke lever 94 is pushed upwards to assume a fully closed position as shown in FIG. 14 at the time the combustion engine is desired to be started, the valve body 92 closes the air inflow port 88. The valve body 92 is provided with a passage shutter 98 for closing the auxiliary air hole 91, that is, the auxiliary air introducing passage 70, when the valve body 92 is in position to close the air inflow hole 88, through a stay 99 so as to protrude laterally of the valve body 92. Accordingly, at the time of engine start, air flows into the air inflow hole 88 only from a small hole 92*a* defined in the choke valve body 92. The passage shutter 98 referred to above is, when the choke valve CH is in a fully opened position as shown in FIG. 13, positioned upstream of the air inflow hole 88.

Thus, even in the two-stroke cycle combustion engine utilizing the standard choke valve CH, a favorable startability of the engine can be maintained. In other words, if the air passage 23 and the air/fuel mixture passage 24 are throttled down by the choke valve CH at the time of engine start, a substantial amount of air would flow from the auxiliary air hole 91 into the auxiliary air introducing passage 70 to lean the air/fuel mixture, accompanied by lowering the startability. However, this problem can be solved in the fourth embodiment, since the auxiliary air introducing passage 70 is closed by the passage shutter 98 in the manner hereinabove described.

On the other hand, when at any time other than the starting of the combustion engine, the choke lever 94 is pushed downwards to assume a fully opened position as shown in FIG. 13, the choke valve CH is held in position to fully open the air inflow hole 88 and also to open the auxiliary air introducing passage 70 and, therefore, transit from the idling condition towards the rapid acceleration can be accomplished smoothly in a manner similar to that described in connection with the first embodiment of the present invention hereinbefore fully described.

Figure 15:
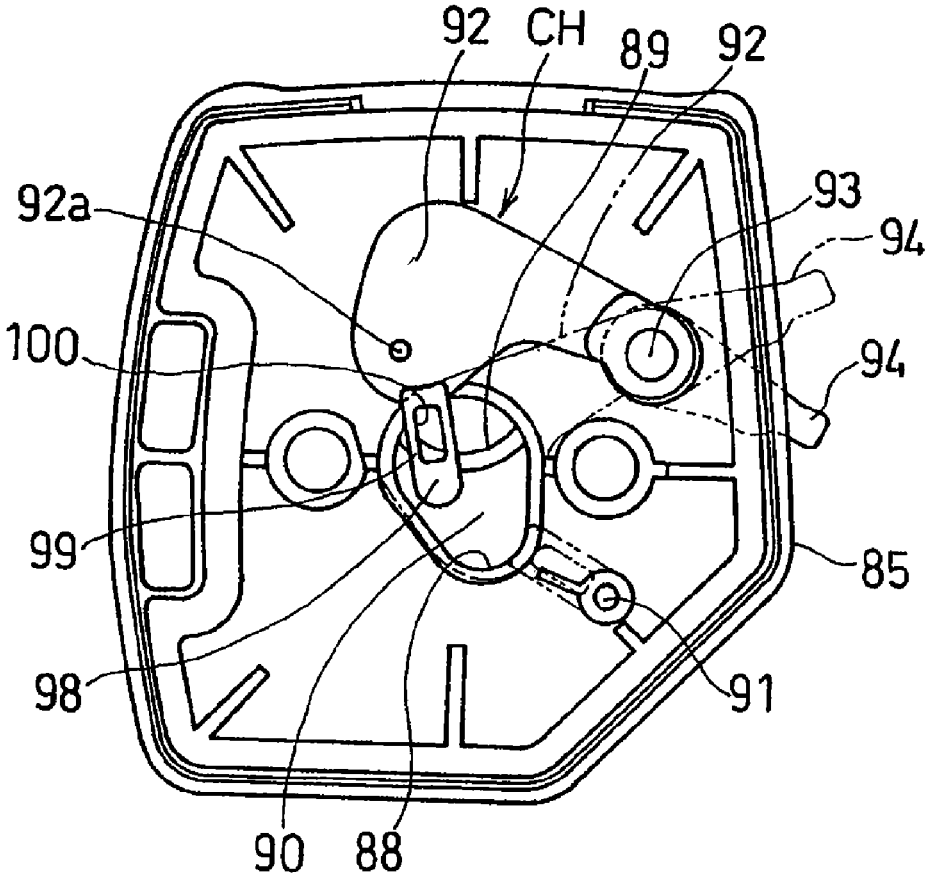
FIG. 15 is a left side view showing a cleaner casing according to a fifth preferred embodiment of the present invention.

In a fifth preferred embodiment of the present invention shown in FIG. 15, the stay 99 for supporting the passage shutter 98 is formed with a slot 100. While when the valve body 92 of the choke valve CH is held in position to fully open the air introducing passage 98, the stay 99 for supporting the passage shutter 98 is positioned upstream of the air inflow hole 88 enough to somewhat disturb the amount of air flowing into the air introducing hole 88 as in the case of the fourth embodiment, the fifth embodiment shown in FIG. 15 is effective to allow a substantially large amount of air to be smoothly introduced into the air inflow hole 88 through the slot 100 defined in the stay 99.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. Accordingly, such changes and modifications are, unless they depart from the scope of the present invention as delivered from the claims annexed hereto, to be construed as included therein.

EXPLANATION OF REFERENCE NUMERALS

1: Combustion chamber
3: Carburetor
4: Air cleaner
4A: Auxiliary air cleaner
22: Insulator (Spacer)
23: Air passage
24: Air/fuel mixture passage
28: Rotary valve unit
30: Air scavenging passage (Scavenging passage)
31: Air/fuel mixture scavenging passage (Scavenging passage)
50: Air/fuel mixture valve (Valve)
51: Air valve (Valve)
54: Main nozzle
58: Needle valve
69: Lift up lever
70, 70A, 70B: Auxiliary air introducing passage
70*a*: Throughhole
80: Connecting tube (Tube)
98: Passage shutter
A: Air
CH: Choke valve
E: Engine body
M: Air/fuel mixture
S: Start operating mechanism

What is claimed is:

1. In a two-stroke cycle combustion engine of an air scavenging type having an air cleaner in which an air/fuel mixture and air are respectively introduced into a combustion chamber through a scavenging passage, and a valve unit adjusts an opening of each of an air passage for supplying the air from the air cleaner to the scavenging passage and an air/fuel mixture passage for supplying the air/fuel mixture to the scavenging passage, the improvement comprising:

a separate auxiliary air introducing passage for introducing a predetermined quantity of air directly from the air cleaner to the air/fuel mixture passage at only a location downstream of the valve unit wherein the ratio of air/fuel mixture introduced to the engine will be supplemented by the auxiliary air to stabilize an idling operation of the engine and enable a smooth rapid acceleration of the engine from an idling mode of operation.

2. The two-stroke cycle combustion engine of the air scavenging type as claimed in claim 1 further including a spacer member offsetting the valve unit from the engine, wherein the auxiliary air is introduced into the extension of the air/fuel mixture passage through the spacer member.

3. The two-stroke cycle combustion engine of the air scavenging type as claimed in claim 1 further including a delivery tube connected to the air cleaner for forming the separate auxiliary air introducing passage.

4. The two-stroke cycle combustion engine of the air scavenging type as claimed in claim 1, in which the air is so set as to be introduced into the combustion chamber prior to the air/fuel mixture.

5. The two-stroke cycle combustion engine of the air scavenging type as claimed in claim 1, in which the auxiliary air introducing passage has a downstream portion defined in a spacer which is disposed between a carburetor, having the valve unit, and an engine body.

6. The two-stroke cycle combustion engine of the air scavenging type as claimed in claim 5, in which the auxiliary air introducing passage has a through hole defined in the carburetor for introducing a clean air, which has passed through an air cleaner, into the air/fuel mixture passage.

7. The two-stroke cycle combustion engine of the air scavenging type as claimed in claim 1, in which the auxiliary air introducing passage includes a tube for introducing a clean air, which has passed through an air cleaner, into the air/fuel mixture passage.

8. The two-stroke cycle combustion engine of the air scavenging type as claimed in claim 1, in which the valve unit comprises a single rotary valve unit for adjusting the opening of both of the air passage and the air/fuel mixture passage and further comprising a needle valve movable across the valve unit in a direction axially of the valve unit for adjusting the opening of a main nozzle for fuel and a lift up lever movable in a direction required to open the needle valve to thereby increase the concentration of fuel at the time of start of the combustion engine.

9. The two-stroke cycle combustion engine of the air scavenging type as claimed in claim 1, further comprising a choke valve disposed at a location upstream of the valve unit for throttling down the opening of the air passage and the air/fuel mixture passage at the time of start of the combustion engine and a passage shutter provided in the choke valve for closing the auxiliary air introducing passage at the time of start of the combustion engine.

10. The two-stroke cycle combustion engine of the air scavenging type as claimed in claim 8 wherein the main nozzle has a fuel injecting port of an inverted triangular shape to increase the concentration of fuel at the time of the start up of the combustion engine.

11. The two-stroke cycle combustion engine of the air scavenging type as claimed in claim 1, wherein the auxiliary air introducing passage bypasses an air/fuel mixture valve of the valve unit to communicate an upstream portion of the air/fuel mixture passage to a downstream portion thereof.

* * * * *